United States Patent [19]

Kamogawa et al.

[11] 3,968,672

[45] July 13, 1976

[54] METHOD OF ROLLING SHAPED STEEL MEMBERS HAVING FLANGES AND APPARATUS THEREFOR

[75] Inventors: Yoshiro Kamogawa; Akihiro Saoka, both of Sakai, Japan

[73] Assignee: Nippon Steel Corporation, Tokyo, Japan

[22] Filed: Dec. 3, 1974

[21] Appl. No.: 529,107

[30] Foreign Application Priority Data

Dec. 5, 1973 Japan ..... 48-135965

[52] U.S. Cl. ..... 72/225; 72/251

[51] Int. Cl.[2] ..... B21B 1/08

[58] Field of Search ..... 72/225, 250, 251, 227

[56] References Cited

UNITED STATES PATENTS

| | | | |
|---|---|---|---|
| 2,962,917 | 12/1960 | Drysdale | 72/227 X |
| 3,165,948 | 1/1965 | Kishikawa | 72/225 |
| 3,566,656 | 3/1971 | Matsumuro | 72/227 |
| 3,678,721 | 7/1972 | Kishikawa | 72/225 |
| 3,699,794 | 10/1972 | Bacholt | 72/225 |

*Primary Examiner*—Milton S. Mehr

*Attorney, Agent, or Firm*—Wenderoth, Lind & Ponack

[57] ABSTRACT

A method of rolling shaped steel members having flanges by a universal rolling mill, wherein the to-be-rolled material is so guided as to make the center of the width of the flanges nearly level with the pass line of the universal rolling mill before the biting of the to-be-rolled material by the working rolls; and the vertical rolls are made to contact the flanges of the to-be-rolled material at or before the position at which the horizontal rolls contact the web of the to-be-rolled material. An apparatus for rolling shaped steel members having flanges is constituted by a universal rolling mill in which the vertical rolls contact the flanges of the to-be-rolled material at or before the position at which the horizontal rolls contact the web of said to-be-rolled material; and a guide device is provided at the entry side of the universal rolling mill to guide the to-be-rolled material so as to make the center of the width of the flanges of the to-be-rolled material nearly level with the pass line of the universal rolling mill.

11 Claims, 16 Drawing Figures

METHOD OF ROLLING SHAPED STEEL MEMBERS HAVING FLANGES AND APPARATUS THEREFOR

BACKGROUND OF THE INVENTION

1. Field of the Invention

The present invention relates, in general, to a method of rolling shaped steel members having flanges and an apparatus therefor, and more particularly to a method of rolling such shaped steel members as H-sectioned members, I beams and rails as products with no shifting of the web and which are very accurate in size; and an apparatus therefor.

2. Description of the Prior Art

Of the various kinds of shaped steel members having flanges, there are some which are rolled by a universal rolling mill having the vertical rolls arranged on both sides of the to-be-rolled material and the horizontal rolls spaced vertically above and below the material, with the spindles of all these rolls positioned within the same or nearly the same vertical section. One of the problems with the operation of such a universal rolling mill is the great difficulty in setting the center of width of the flanges at nearly the same level as the center the thickness of the web. Taking the rolling of an H-sectioned steel members for instance, as shown in FIG. 1, there is the possibility that in producing such members there will be a shifting of the web, by the distance $\Delta L$ between the central line AA of width of the flanges and the central line BB of thickness of the web.

The following is an explanation of the cause of the shifting of the web using the rolling a H-sectioned steel member as an example:

FIG. 2 shows the rolling of an H-sectioned steel member 1 by the horizontal rolls 11, 12 of a universal rolling mill, wherein the vertical rolls are not shown for the purpose of simplification; and the H-section 1 is shown in the long direction. Numeral 15 denotes a roller table; Yv indicates the line indicating the position at which the vertical rolls start the reduction of the flanges 2 of the H-section steel member 1; and YH indicates the line indicating the position at which the horizontal rolls 11, 12 start the reduction of the web 3 of the H-sectioned steel member 1; and $Y_0$ indicates the line running through the centers of the spindles of the horizontal rolls 11, 12. In the present invention, the distance between $Y_0$ and $Y_H$ is called the projected contacting length $l_H$ of the biting by the horizontal rolls; and the distance between $Y_0$ and $Y_V$ is called the projected contacting length $l_V$ of the biting by the vertical rolls.

$$\text{If } l_H < l_V \ldots (1),$$

the rolling of the H-sectioned steel member 1 will start with the reduction of the flanges 2 by the vertical rolls. Thus, the H-sectioned steel member 1 is gripped by the contacting of the vertical rolls with the outside of the flanges and also the contacting of the sides of the horizontal rolls with the inside of the flanges, so that it is held against movement vertically because of friction force produced between the member and the working rolls.

Then, the reduction of the web will start with the horizontal rolls 11, 12. In such a case, there is a deviation of the pass line C'C running parallel with the rolling direction through the center of the space between the horizontal rolls 11 and 12, from the line, B'B running through the center of width of the flange of the H-sectioned steel member, hereinafter called the central line of the flanges, and the web 3, which is initially lower than it should be as shown with the double hatching 6 on the left portion of FIG. 2, will be shifted during the rolling of such material higher than it should be, as shown with the double hatching 7 on the right portion of FIG. 2. Such phenomenon is called the "shifting of the web", which is the main cause of the production of "shifted webs".

In the case of the rolling of H-sectioned steel members by a universal rolling mill, it is difficult to adjust the arrangement of the working rolls of such universal rolling mill or the posture of the H-sectioned steel member before rolling, so that the line B'B running through the center of width of the flanges of the H-sectioned steel member may not remain level with the pass line C'C of the universal rolling mill throughout the rolling operations; therefore, it is possible that H-sectioned steel members having shifted webs as shown with the double hatching 7 in FIG. 2, are produced.

A guide shoe of a conventional type has been devised which holds the web of the H-sectioned steel member between its hands and guides the web so that the center of the thickness of the web is level with the pass line of the universal rolling mill. In the case of the rolling of such members having already shifted webs, however, such webs are sent into rolling operation with the web shifted so the shifted web remains in the finished H-sectioned steel members.

In order to prevent the shifting of the web, there has been proposed the following device:

Referring to FIGS. 3 and 4, an arrangement used in the rolling of an H-sectioned steel member 1 having flanges 2 by a universal rolling mill having vertical rolls 13, 14 and horizontal rolls 11, 12 with all their spindles positioned within the same or nearly the same vertical section, has the biting position $Y_H$ for the horizontal rolls nearly coinciding with or preceding he biting position $Y_V$ for the vertical rolls. This is accomplished by adjusting the ratio of the diameter of the vertical rolls and the horizontal rolls and additionally by adjusting the reduction carried out in the rolling pass, thereby preventing the shifting of the web. However, the arrangement is not effective in the case of rolling materials having shifted webs, such as H-sectioned steel members in which the center of thickness of the web 3 is shifted from the center of width of the flanges 2, so that rolling operations are effected without correction of such shifting of the web. In other words, to-be-rolled materials should be free of the shifted web before being put into rolling operation. Another problem with the arrangement is that there is the possibility of irregular spread of the width of the flanges at points $f_1$-$f_4$ in FIG. 1 due to irregularity of reduction and temperature distribution, such irregular spread, particularly the difference between the upper and the lower portions of the flange from its center, making it impossible to correct the shifting of the web during rolling operations, resulting in the production of products with shifted webs.

Besides the abovementioned arrangement, there has been devised another device, according to which without regard to the biting position of the horizontal rolls and the biting position of the vertical rolls on the flanges, means is provided that applies a pair of forces that work counter to each other in a vertical section to the upper and the lower edges of the respective flanges at an appropriate position before the space between the working rolls with continuous change of strength according to the shifting of the web from the theoretically ideal position for the center of its width, so as to act on the edges upwards or downwards within the vertical section. The means of this device is constituted by guide rolls or means having the same function as such rolls between which the to-be-rolled material is placed just before the space between the working rolls as the material is bitten into by the working rolls, and to move said guide rolls or the like means are moved up or down, thereby subjecting the web of the material to a bending force.

However, this device has a problem that in order to set the center of thickness of the web at the center of width of the flange, there are used only a pair of forces working counter each other and acting vertically upwards or downwards, and such forces, accordingly, are required to be very strong, so that the rolling apparatus using such device must be largesized, resulting in a great economical disadvantage. The apparatus also must have a complicated construction, because such forces move continuously up or down within one and the same vertical section, requiring a great amount of labor for maintenance, which constitutes another disadvantage of the device. Also, when using the device, it is necessary to adjust the bending force to meet the changing shift of the web, making it necessary to use a detector of the position of the hot steel members for continuous detection of their position. However, there have not yet been commercialized any detectors that can satisfy all the technical requirements, including the sufficiently high accuracy of detection. Even if such detector is developed, it will only be with great difficulty and at great cost.

SUMMARY OF THE INVENTION

It is an object of the present invention to provide a method of economically rolling shaped steel members having flanges such as H-sectioned members, I beams and rails as products with no shifting of the web and which are very accurate in size.

Another object of the present invention is to provide a method of correcting the shifted web of to-be-rolled materials before the rolling by a universal rolling mill, thereby producing shaped steel members having flanges without shifting of the web.

A further object of the present invention is to provide an apparatus for rolling shaped steel members having flanges, having a simple structure and which can be constructed at low cost, but which is effective in practicing the abovementioned method.

In order to achieve the abovementioned objects, the method of the present invention for rolling shaped steel members having flanges, comprises guiding the to-be-rolled material into the rolling mill so as to make the center of the width of the flanges of said to-be-rolled material nearly level with the pass line of the universal rolling mill before the biting of said to-be-rolled material by the working rolls; and causing vertical rolls to contact the flanges of said to-be-rolled material before the position at which the horizontal rolls contact the web of said to-be-rolled material.

The apparatus for effectively practicing the above described method comprises a universal rolling mill having a ratio of the diameters of the horizontal rolls and the vertical rolls and/or the amount of reduction carried out, respectively by the horizontal rolls and the vertical rolls, so as to cause the vertical rolls to contact the flanges of said to-be-rolled material at or before the position at which the horizontal rolls contact the web of said to-be-rolled material, and also a guide device provided at the entry side of said universal rolling mill to guide the to-be-rolled material so as to make the center the width of the flanges of said to-be-rolled material nearly level with the pass line of said universal rolling mill.

DESCRIPTION OF THE PREFERRED EMBODIMENT

The following a detailed explanation of an embodiment of the method of the present invention for the production of H-sectioned steel members, in comparison with the known methods.

Figure 5:
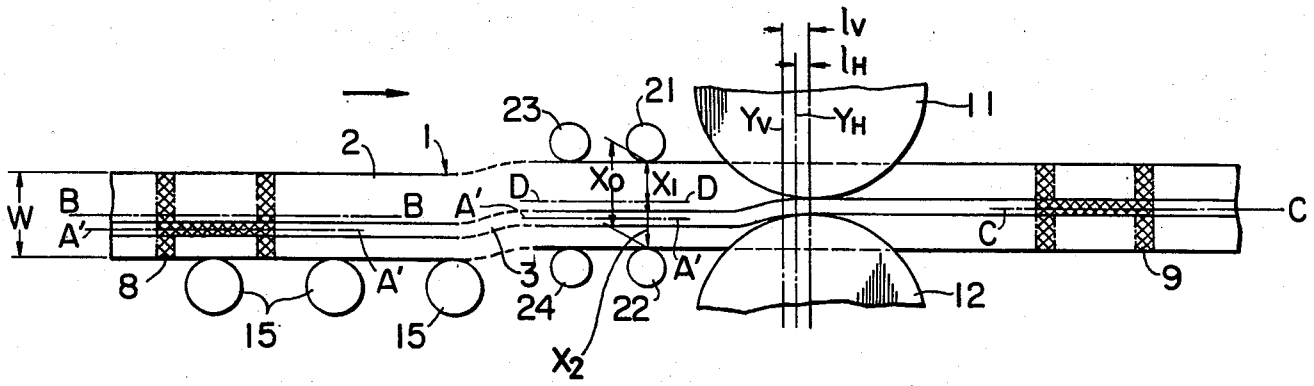
FIG. 5 is an explanatory diagram of the shifting of the web to the right level of the to-be-rolled material according to the present invention.

FIG. 5 is an explanatory view showing the method of rolling according to the present invention. The universal rolling mill used therein has the ratio of the diameters of the horizontal rolls and the vertical rolls and/or has the horizontal rolls and the vertical rolls adjusted for an amount of reduction as to attain the relation of $l_H < l_V$ according to formula (1), Furthermore, on the entry side of the universal rolling mill, there are provided a pair of vertically spaced guide rolls 21, 22 at a distance of about two times the diameter of the horizontal rolls 11, 12 from the center of the shafts thereof, and another pair of vertically spaced guide rolls 23, 24 at an appropriate distance, say, two to eight times the width of the flanges of the H-sectioned steel member from said guide rolls 21, 22. These guide rolls guide the flanges 2 of the beam 1 from an out of alignment position due to such factors as sagging or irregularities in the straightness of the beam, which are represented by the dotted line portion of the beam, into the pass formed by horizontal rolls 11 and 12 and material rolls 13 and 14. The spaces XO between the guide rolls 21 and 22 and between the guide rolls 23 and 24, is nearly equal to the width W of the flanges of the H-sectioned steel member. These guide rolls are so adjusted between each pair, that is, that the line DD running through the center of said spaces $X_0$ (hereinafter called the "central line") nearly agrees with the pass line C'C of the universal rolling mill. Therefore, irrespective position-wise of the central line A'A' of the web, the central line B'B of the flanges is made to nearly agree with the pass line C'C; and, as described above, the rolling according to the present invention causes the web to shift, so that the web of the H-sectioned steel member which is below the cenral line B'B as shown at the double hatched portion 8 on the left portion of the drawing, is shifted up as shown at the double hatched portion 9 on the right of the drawing, so as to make the central line A'A' of the web coincide with the pass line CC. The amount of shift has been exaggerated in the drawings for purposes of showing the shift clearly. In this case, there will be produced sufficient force to shift the H-sectioned steel member up (or down) because of the shifting of the web, but such force is received by the sides of the horizontal rolls and the vertical rolls, as these are reducing the flanges, so that the guide rolls 21, 22, and 23, 24 are not subjected to said force. This point will be explained in further detail.

Figure 6:
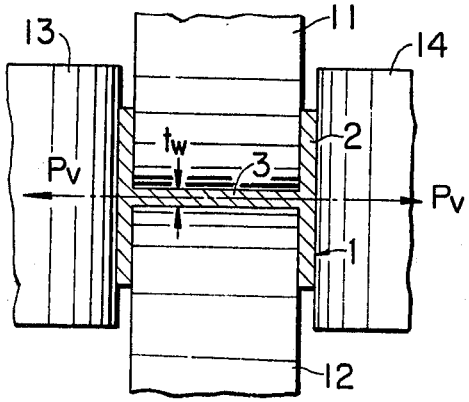
FIG. 6 is a sectional diagrammatic view showing the reaction force produced in the rolling operations as it works upon the vertical rolls during operation.
Figure 2:
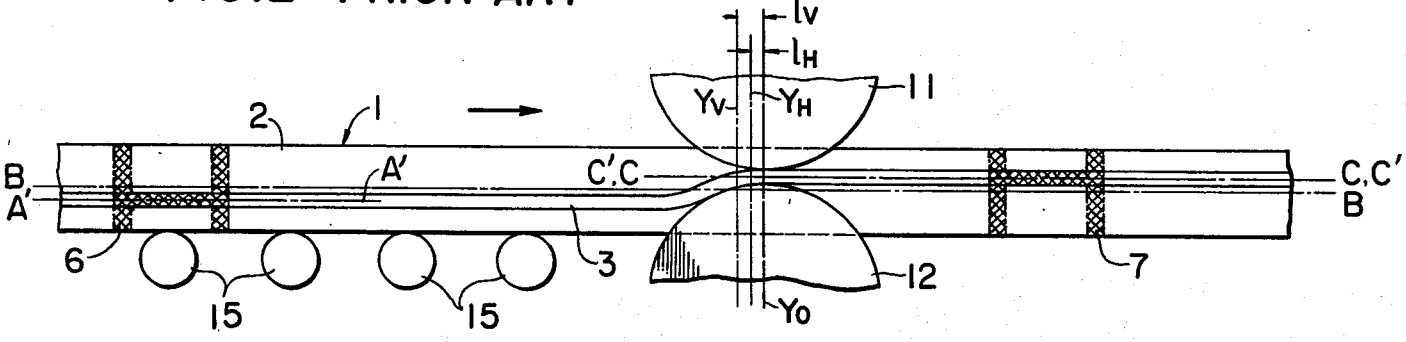
FIG. 2 PRIOR ART
FIG. 2 is an explanatory diagram of the shifting of the web according to the conventional methods.

FIG. 6 shows an H-sectioned steel member 1 being rolled by the horizontal rolls 11, 12 and the vertical rolls 13, 14. In this case, the force a produced by the horizontal rolls 11, 12 to shift the web, is considered to be equal to that necessary for shearing deformation of the crossing areas of the web and the respective flanges.

$$\text{Therefore, } \gamma a = 2K_f \cdot l_H \cdot t_w \ldots \quad (2)$$

where:

$K_f$ : Deformation resistance (kg/mm²)

$l_H$ : Projected contacting length of the biting by the horizontal rolls (mm)

$t_w$ : Thickness of the web (mm)

$\tau_a$ : Force produced by the horizontal rolls to shift the web (kg)

Force T produced between the sides of the horizontal rolls 11, 12 and the vertical rolls 13, 14 is represented by the following formula:

$$T = 4 \cdot \mu \cdot P_V \ldots \quad (3)$$

where:

$P_V = K_f \cdot l_V \cdot Q_V \cdot F_h$ $\mu$ : Coefficient of friction between the to-be-rolled material and the working rolls.

$P_V$: Reaction force produced on the vertical rolls in rolling operations (Kg)

$l_V$: Projected contacting length of the biting by the vertical rolls (mm)

$Q_V$: Function of reduction force $F_h$: Width of the flanges (mm)

Therefore:

$$\frac{T}{\tau a} = \frac{2 \cdot \mu \cdot Q_V \cdot Fh}{tw} \cdot \frac{l_V}{l_H} \quad (4)$$

If $$\frac{2 \cdot \mu \cdot Q_V \cdot Fh}{tw} \geqq 1.0 \quad (5)$$

the rolling condition $l_V/l_H > 1.0$ is converted to $T/\tau a > 1.0$

This means that the force produced during the rolling by the universal rolling mill to be used for shifting the to-be-rolled material vertically for the correction of the shifting of the web is received by the sides of the horizontal rolls 11, 12 and also the vertical rolls 13, 14 through the reduction of the flanges 2, leaving almost no force on the guide rolls 21, 22 and 23, 24.

Therefore, the guide rolls 21, 22, 23, 24 are used only in making the line B'B running through the center of the width of the flanges of the to-be-rolled material be in agreement with the pass line, without receiving the force produced, as described above by the shifting of the web to shift the H-sectioned steel member up or down, thereby making it possible to achieve the object of the present invention by using such simple mechanism as described above.

In the ordinary case of rolling shaped steel members such as H-sectioned members, the following is considered to be correct:

$$\mu = 0.3$$

$$Q_V = 0.8 - 1.2$$

$$Fh/tw > 9$$

Therefore, $$\frac{2 \cdot \mu \cdot Q_V \cdot Fh}{tw} > 1 \ ,$$

causes no problem.

Concerning $l_V/lh$, it may be equal to 1.0, but it has been found that actually a relationship $l_V/l_H > 1.0$ makes rolling operations go smoothly.

In the embodiment of FIG. 5, the guide rolls 21, 22, 23 and 24 will be sufficient only if the distance $X_1$ between the pass line CC and the upper guide rolls 21, 23 can be kept equal to the distance $X_2$ between the pass line CC and the lower guide rollers 22, 24 ($X_1 = X_2$), thus requiring no moving up or down of the to-be-rolled material such as an H-sectioned steel member as it is rolled by the working rolls, which is different from case of the rolling according to the conventional method.

In order to attain the rolling condition of $X_1 = X_2$ by the adjustment of the guide rolls, it is not necessary to make the upper guide rolls 21, 23 and the lower guide rolls 22, 24 move independently, but it is better for the simplification of mechanism and for easier maintenance to design them to operate in tandem. Also, it is possible to design the guide device with the set of the upper guide rolls 21, 23 combined with the set of the lower guide rolls 22, 24. As for the appropriate number of pairs, each pair consisting of an upper guide roll and a lower guide roll, any number is more than one pair will do, but according to the experience of the inventors, two pairs are enough. As of the positions for such guide rolls to be provided, the nearer to the horizontal rolls, the better for the fulfilment of their function, but taking into consideration various conditions for smooth operation, particularly for easier maintenance, the optimum distance is within one to three times the diameter of the horizontal rolls. As for the space between the guide rolls 21 and 23, the apparatus works best when it is two to eight times the width of the flanges of the to-be-rolled material, which is an H-sectioned steel material in the case of FIG. 5, but the design can vary subject to all other designing conditions with respect to the rolling apparatus. Instead of guide rolls used in the abovementioned embodiment, there can be used guide shoes by themselves or in combination with guide rolls. As for possibility of damage to the flanges by the use of guide shoes, it has been negated by smooth operation with guide shoes. The same results can be obtained with guide rolls and shoes in the mass production of shaped steel members of the same size.

Referring the spaces $X_0$ respectively between the guide rolls 21 and 22 and between the guide rolls 23 and 24, the above statement, that it is equal to the width W of the flange, does not mean that it is limited strictly to this dimension. On the contrary, smooth guiding can be achieved only with difficulty, if there is no clearance included such space. In other words, because the materials to be rolled into H-sectioned steel members are not exactly the same in size nor are they free from bending and warping, said space $X_0$ should be somewhat greater than the width W of the flange. As the inventors of the present invention have found from experience, a clearance of zero to 10 mm provies a smooth operation in the rolling of an H-sectioned steel member. The size of such clearance, however, should be according to the conditions of the rolling apparatus in which it is used. Because of this requirement in actual operation, the agreement of the center of width of the flanges with the pass line may vary by the amount of the clearance, although the smaller the clearance and lack of agreement of the center of the width of the flanges with the pass line, the better. The statement that the to-be-rolled material is guided with the center of the width of the flanges nearly or substantially agreeing with the pass line, should be construed as described above.

The guidance by the guide rolls can be achieved conventionally by using hydraulic pressure, air pressure or the like or by using a mechanical device such as screw, so long as the means do not deviate from the gist of the present invention.

Figure 1:
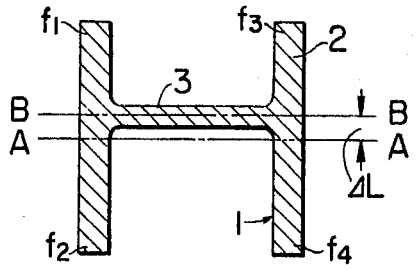
FIG. 1 is a sectional view of an H-sectioned steel member for explaining the shifting of the web of the to-be-rolled material.
Figure 3:
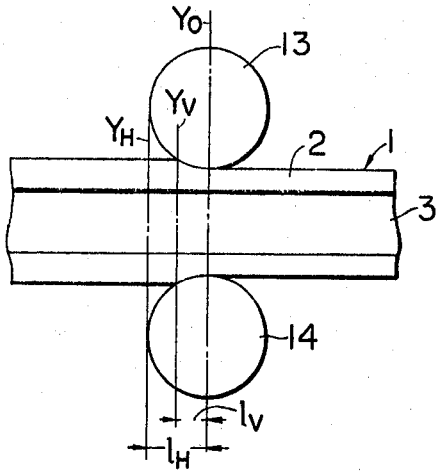
FIG. 3 PRIOR ART
FIG. 3 is an explanatory diagram showing the biting of the to-be-rolled material by the vertical rolls of a conventional universal rolling mill for the prevention of the shifting of the web in the rolling of an H-sectioned steel member.
Figure 4:
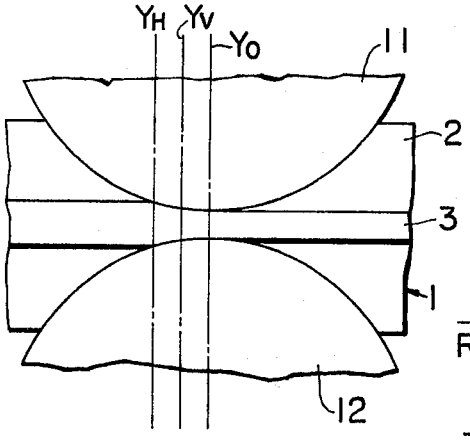
FIG. 4 PRIOR ART
FIG. 4 is a diagram similar to FIG. 3 showing the biting of the to-be-rolled material by the horizontal rolls of a conventional universal rolling mill for the prevention of the shifting of the web in the rolling of an H-sectioned steel member.
Figure 7:
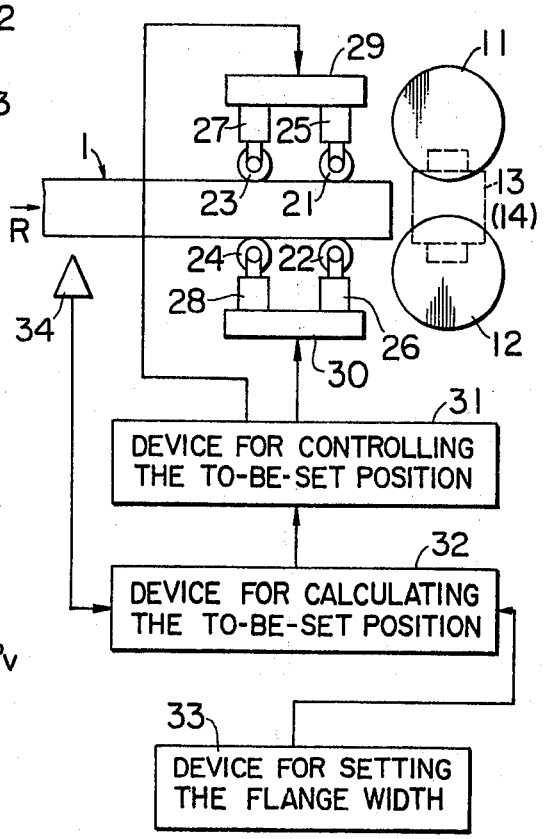
FIG. 7 is a schematic illustration of an embodiment of the rolling apparatus according to the present invention.

The above theoretical description of the present invention will be supported by the following description of the rolling apparatus for practicing the method of the present invention. In FIG. 7, numerals 25 to 28 denote means such as screws for setting the position of the guide rolls; numerals 29 and 30 denote respectively mechanisms for driving the setting means; numeral 31 denotes a device for controlling the to-be-set position; numeral 32 denotes a device for calculating the to-be-set positions; numeral 33 denote a device for setting the flange width; and numeral 34 denotes a flange width sensor.

When the to-be-rolled material such as an H-sectioned steel member moves in the direction of the arrow R, the flange width sensor 34 which 15 arranged on the entry side of the guide rolls 21 to 24, acts to measure the width of the flanges, and then issue a signal to be put into the device 32 for calculating the to-be-set position. In the event that the width of the flange of the H-sectioned steel member 1 is known by the use of the pass schedule and the signal for setting the space between working rolls in the previous operation, such information can be supplied, as an input signal the device for calculating the to-be-set position 32 through the device for setting the flange width 33. To the device for calculating the to-be-set position 32 there applies the following formula showing the abovementioned addition of the width of the flange and a clearance, as follows:

$$W + a = X_0 \ldots (6)$$

where:

a : Clearance

W : Width of the flange $X_0$ : Distance set between guide rolls, that is space between guide rolls.

Figure 8:
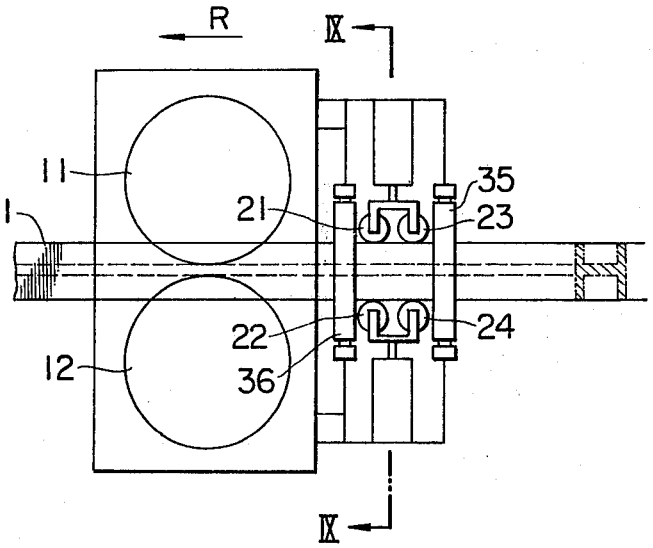
FIG. 8 is a schematic illustration of an embodiment of another embodiment of the rolling apparatus according to the present invention.
Figure 9:
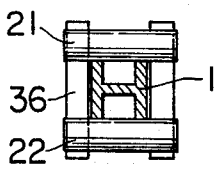
FIG. 9 is a sectional view of the rolling apparatus taken on the line IX—IX in FIG. 8.
Figure 10:
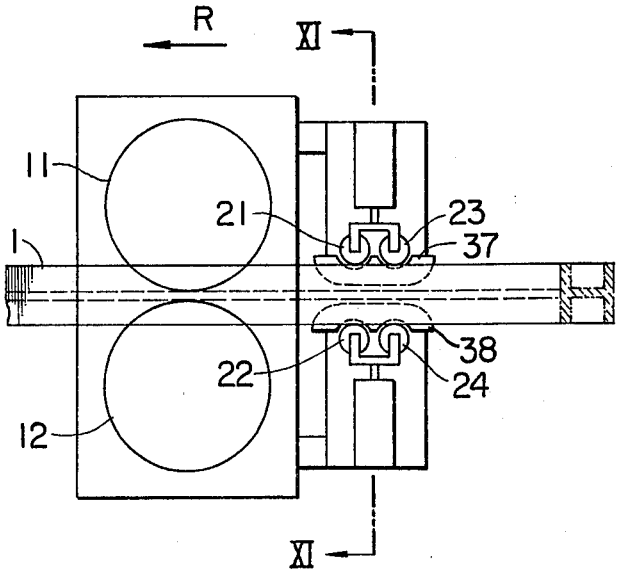
FIG. 10 is a schematic illustration of a further embodiment of the rolling apparatus according to the present invention.
Figure 11:
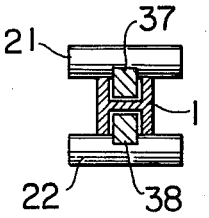
FIG. 11 is a sectional view of the rolling apparatus taken on the line XI—XI in FIG. 10.

The value of the space between guide rolls obtained by the operation according to the foregoing formula is sent to the device 31 for controlling the to-be-set position; then, an actuating signal is sent through the device 31 for controlling the to-be-set position to the mechanisms 29, 30 for driving the setting means, so as to drive the setting means 25 – 28, setting the guide rolls 21 – 24 to the to-be-set positions. The mechanisms for driving the means 25 – 28 have position sensors (not shown) as attachments, which feed back signals for setting the guide rolls exactly to the to-be-set position. These devices are cited as one kind of such devices, therefore, any simplification or modification is permissible unless it deviates from the gist of the present invention. For example, there can be used as subsidiary mechanisms, additional guide rolls of the vertical type 35, 36 as shown in FIGS. 8 and 9 for making smoother the guidance of the H-sectioned steel member 1, or web guide means of the shoe type 37, 38 supported by supporters (not shown) as shown in FIGS. 10 and 11 for the prevention of shaking of the H-sectioned steel member 1 transverse to the rolling direction.

Figure 12:
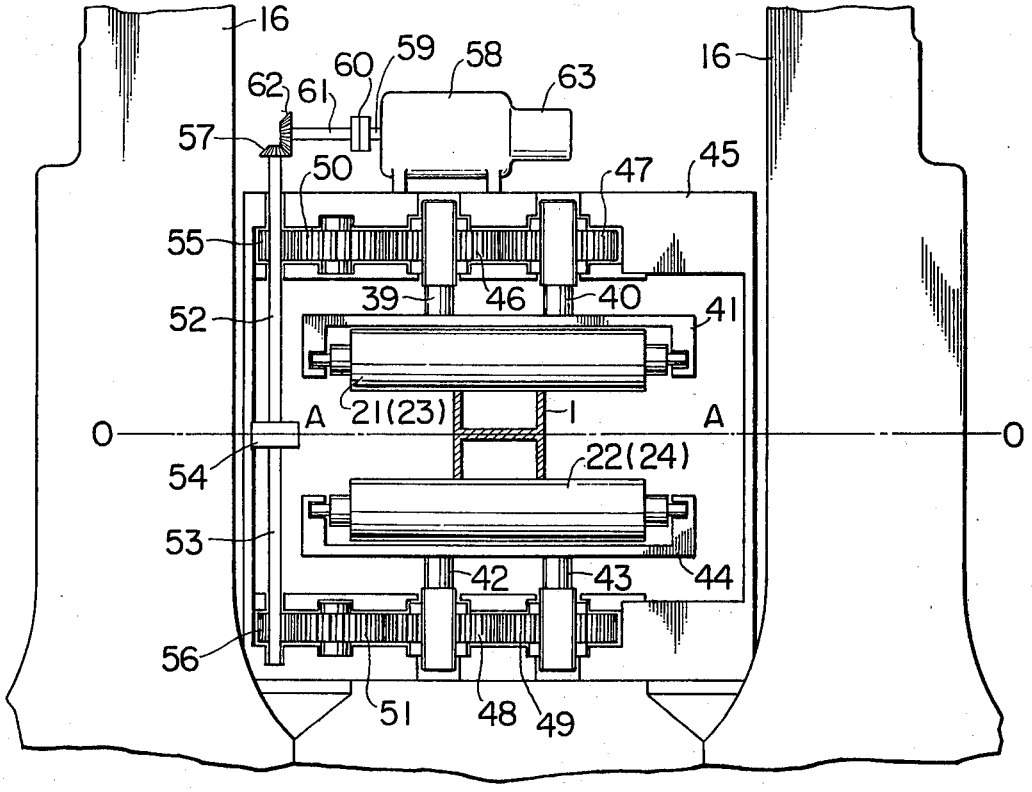
FIG. 12 is a front view of an embodiment of the guide mechanism according to the present invention.
Figure 13:
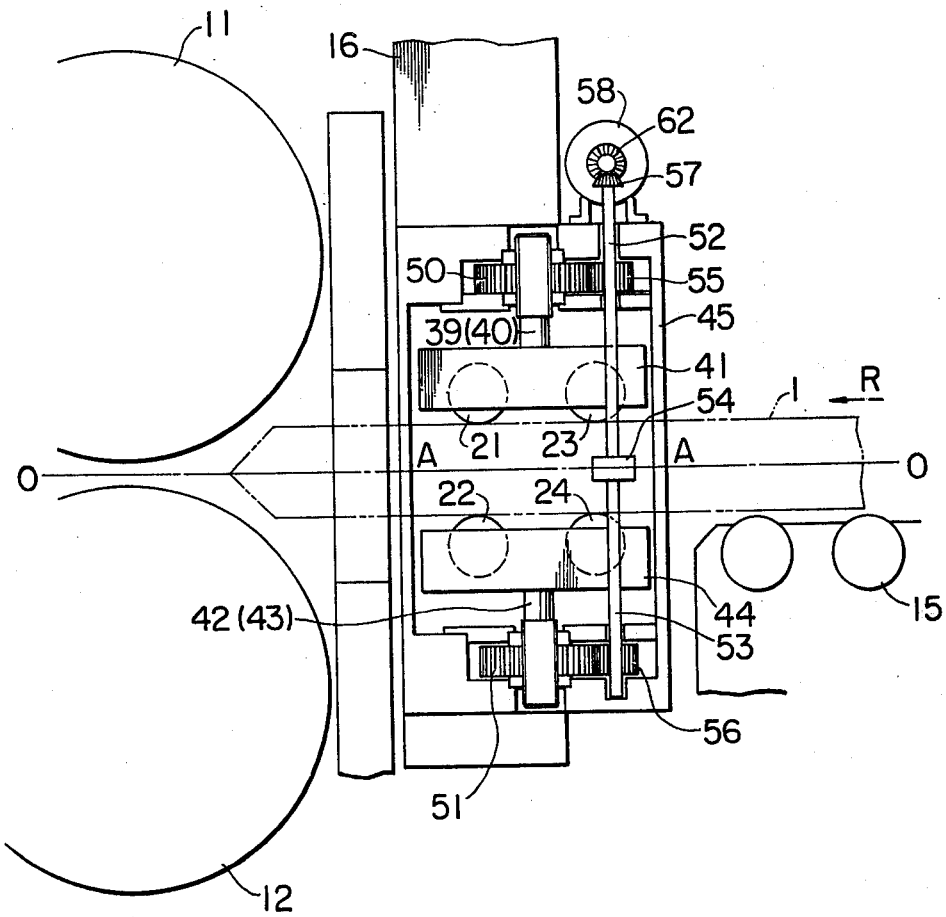
FIG. 13 is a side view of the guide mechanism shown in FIG. 12.

In FIGS. 12 and 13, numeral 1 denotes a to-be-rolled material; numerals 11 and 12 denote the horizontal rolls of a universal rolling mill; numeral 15 denotes a roller table; numeral 16 denotes the housing of the universal rolling mill; and numerals 21, 22, 23 and 24 denote guide rolls; with the line AA running through the center between the upper and the lower guide rolls agreeing with the line 00 running through the center of the space between the spindles of the horizontal rolls 11 and 12.

The upper guide rolls 21, 23, are mounted for free rotation on a guide roll supporting frame 41 having screws 39, 40 fixedly mounted thereon; and the lower guide rolls 22, 24 are mounted likewise for free rotation on a guide roll supporting frame 44 having screws 42, 43 fixedly mounted thereon. The threads of the screws which are vertically aligned, say, the screws 39 and 42, are opposite in direction each other. On the other hand; a frame 45 fixed on the housing 16 has two sets of adjacent meshing gears 46, 47 and 48, 49 each having an internally threaded center hole, and being mounted on the frame for free rotation. These gears have their respective internal threads engaged respectively with the threads of the screws 39 and 40 and 42 and 43. The fixed frame 45 has mounted thereon for free rotation a gear 50 engaged with the upper gear 46 and also a gear 51 engaged with the lower gear 48.

The fixed frame 45 has transmission shafts 52 and 53 extending perpendicularly and mounted thereon for free rotation. These shafts are connected to each other by an electro-magnetic clutch 54, which may be such a known clutch as a dog clutch or a friction clutch. The transmission shafts 52, 53 have fixed thereon pinions 55 and 56 engaged respectively with the gears 50 and 51. The upper transmission shaft 52 has a bevel gear 57 fixed at the top. The fixed frame 45 has a motor 58 fixed on the top; and at the end of driving shaft 61 connected with the motor shaft 59 through a coupling 60, there is mounted a bevel gear 62 engaged with the bevel gear 57 of the transmission shaft 52. The motor 58 is connected with a mechanism 63 for detecting the positions of the guide rolls 21, 22, 23, 24 by the change of rotation angle of the motor shaft 59.

As for the start of the guide device which is constructed as described above, the motor 58 is operated so as to rotate the transmission shafts 52, 53 by means of the bevel gears 62, 57. The rotation of the gears 55, 50, 46 and 47 and of the gears 56, 51, 48 and 49 move the upper rolls 21 and 23 and the lower guide rolls 22 and 24, vertically. Thus, the upper guide rolls 21 and 23 and the lower guide rolls 22 and 24 move toward or away from each other equal distances. In other words, these sets of guide rolls respectively move vertically toward and away from the line 00 running through the center of the space between the spindles of the horizontal rolls, adjusting said space, providing smooth guidance of the to-be-rolled material 1 according to the size thereof.

Also, in case of a positional change of the pass line 00 upward or downward, the electro-magnetic clutches 54 are so used that the line running through the center of the space between the upper guide rolls 21, 23 and the lower guide rolls 22, 24 is in agreement with the pass line.

Figure 14:
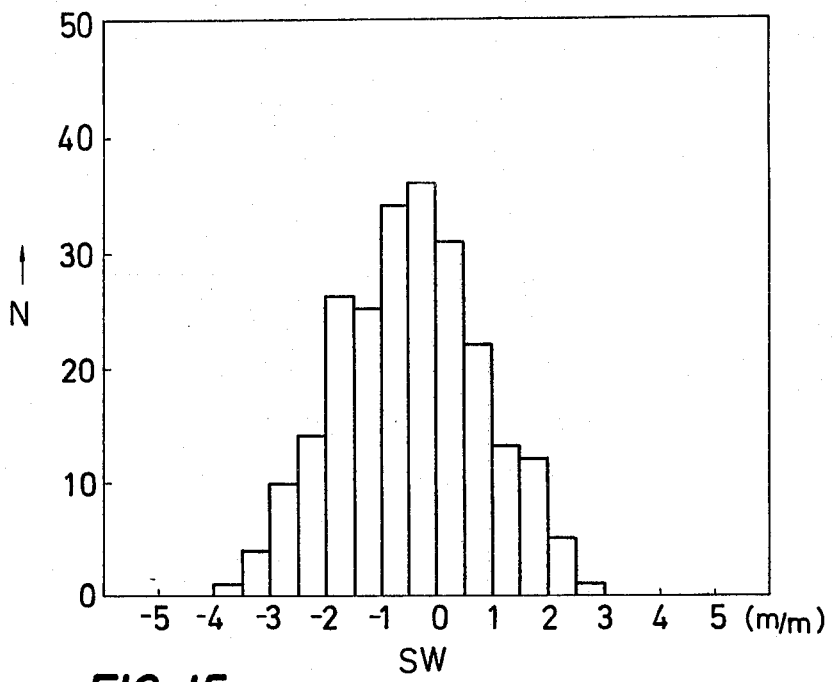
FIG. 14 PRIOR ART
FIG. 14 is a histogram of the shifting of the web of the to-be-rolled material in the rolling of an H-sectioned steel member by the conventional methods.
Figure 15:
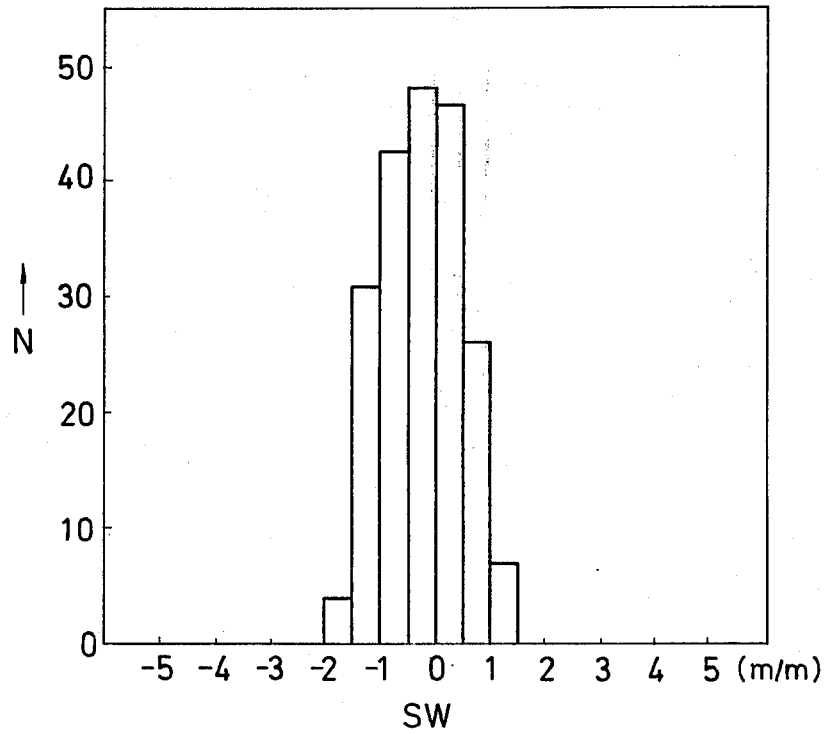
FIG. 15 is a histogram of the shifting of the web of the to-be-rolled material in the rolling of an H-sectioned steel member according to the present invention.

The following is explanation of the comparison of the results of experiments made in the rolling by the method of the present invention with that of experiments made in conventional rolling methods with reference to FIGS. 14 and 15. These drawings show histograms of the shifting of the web of the to-be-rolled material during rolling by other methods than that of the present invention and by the method of the present invention. In those drawings, the shifting SW of the web from the center of the width of the flanges is represented in millimeters on the horizontal axis; and the measured number, that is, the number of the rolled shapes is represented on the vertical axis. As clearly understandable from the drawings, the rolling according to the present invention makes very small the absolute value of the amount of shift of the web of the H-sectioned steel member, or enhances the yield of shapes of good quality.

Figure 16:
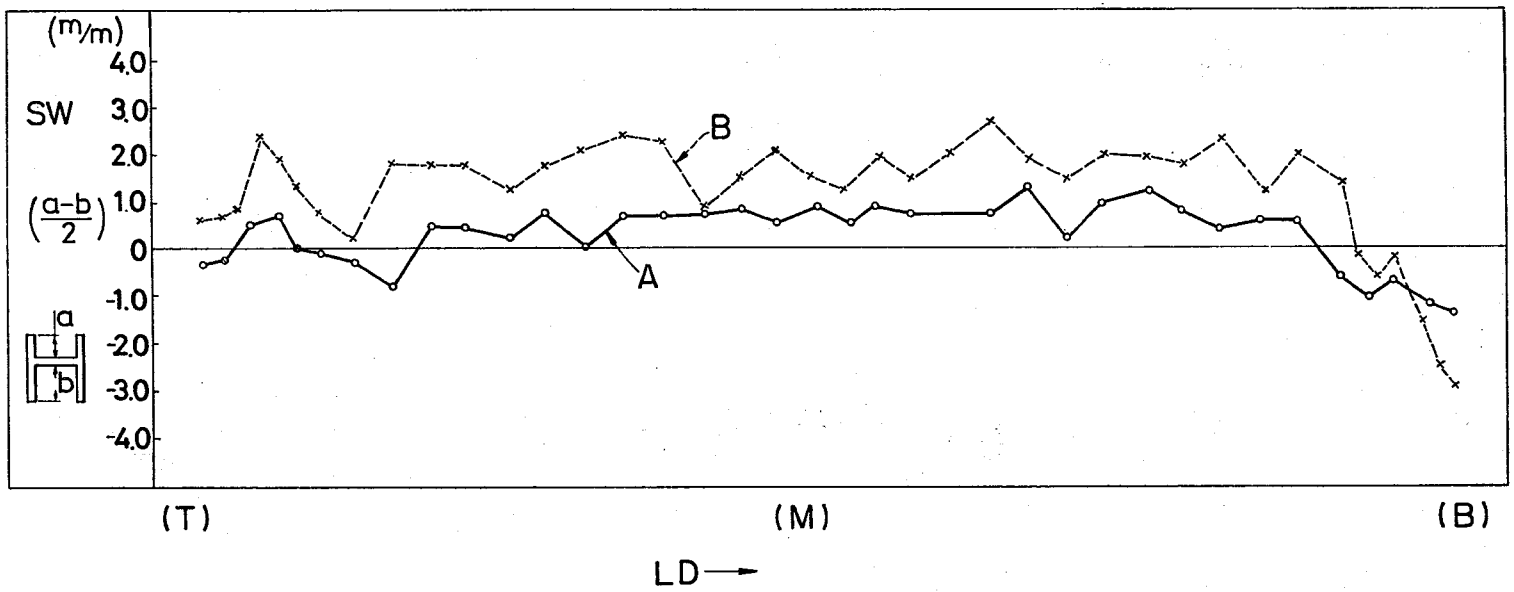
FIG. 16 is a graphic representation of a comparison between the conventional method and the present invention in the shifting of the web in the direction the length of the H-sectioned steel member.

A comparison between the conventional method (B) and the method of the present invention (A) as to the effect of the present invention in preventing the shifting of the web in the lengthwise direction of the H-sectioned steel member is shown in FIG. 16. In FIG. 16 the vertical axis indicates the shifting SW from the center line of the web; and the horizontal axis indicates the position of the top T, the middle M and the bottom B of the rolled material in the lengthwise direction LD. This proves that the method of the present invention is effective in improving the production of H-sectioned steel members with smaller shifting of the web.

As described above in detail, the method of the present invention is also effective in the rolling of all other shaped steel members having flanges with smaller shifting of the web. Therefore, it is very economical and useful as an industrial method of producing products of high accuracy in size for various sectors of industry.

We claim:

1. In a method of rolling shaped steel members having flanges and a web by a universal rolling mill having horizontal and vertical working rolls, the improvement which comprises engaging the shaped steel member at least along the tops and bottoms of the flanges at a point immediately ahead of the universal rolling mill with a force sufficient only for guiding the material to be rolled so that the center of the width of the flanges is substantially level with the pass line of said universal rolling mill before the material of the steel member being rolled is bitten into by the working rolls of said universal rolling mill, and causing the vertical rolls of the universal rolling mill to contact the flanges of said material to be rolled no later than the horizontal rolls contact the web of said material to be rolled.

2. The improvement as claimed in claim 1 wherein the vertical rolls are caused to contact flanges prior to the horizontal rolls contacting the web.

3. The improvement as claimed in claim 1 wherein the tops and bottoms of the flanges of the steel members are engaged at at least two points along the length thereof, the first point being from one to three times the diameter of the horizontal roll, and the second point being from two to eight times the width of the flanges from the first point of engagement.

4. An apparatus for rolling shaped steel members having flanges, comprising a universal rolling mill having horizontal and vertical rollers having a size and position for causing the vertical rolls to contact the flanges of the material of the steel member to be rolled no later than the horizontal rolls contact the web of said material of the steel member to be rolled, and a guide device provided at the inlet side of said universal rolling mill for engaging the material of the steel member to be rolled only for bringing the center of the width of the flanges of said material to be rolled substantially level with the pass line of said universal rolling mill.

5. The apparatus as claimed in claim 4 wherein the guide device comprises a plurality of pairs of guide members, each pair of such members being spaced vertically at equal distances from the pass line of said universal rolling mill, and a leveling device connected to said pairs of guide members for adjusting the positions of said guide members vertically in opposite directions and equal distanes.

6. The apparatus as claimed in claim 5 wherein the first pair of members is positioned from one to three times the diameter of the horizontal rolls from said universal rolling mill.

7. The apparatus as claimed in claim 5 wherein the second pair of guide members is positioned from two to eight times the width of the flanges of the material of the steel member to be rolled from said first pair of guide members.

8. The apparatus as claimed in claim 5 wherein the guide members consist of guide rolls.

9. The apparatus as claimed in claim 5 wherein the guide members consist of guide shoes.

10. The apparatus as claimed in claim 5 wherein said apparatus has frames respectively for supporting the upper and the lower members of each pair of guide members, and said leveling device consists of screws fixed respectively to said frame, sets of transmission gears including gears having threads engaged respectively with the threads of the upper and the lower screws, and driving means for driving the transmission gears.

11. The apparatus as claimed in claim 4 further comprising a controller including a flange width sensor positioned ahead of said guide device, and a calculating device coupled to said flange width sensor for calculating the position to which the guide members is to be set according to signals from said flange width sensor, the controller being coupled to said guide members for setting the guide members to the position according to signals from said device for calculating the position to which the guide members are to be set.

* * * * *